US007077763B2

(12) United States Patent
Wahl et al.

(10) Patent No.: US 7,077,763 B2
(45) Date of Patent: Jul. 18, 2006

(54) IRON-TYPE GOLF CLUB HEAD

(75) Inventors: Bret Wahl, Carlsbad, CA (US); Marni Ines, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 70 days.

(21) Appl. No.: 10/436,752

(22) Filed: May 12, 2003

(65) Prior Publication Data

US 2004/0229714 A1 Nov. 18, 2004

(51) Int. Cl.
*A63B 53/04* (2006.01)
*A63B 53/06* (2006.01)

(52) U.S. Cl. ..... 473/334; 473/335; 473/342; 473/349; 473/350

(58) Field of Classification Search ..... 473/324–350, 473/290–291
See application file for complete search history.

(56) References Cited

U.S. PATENT DOCUMENTS

| | | | | | |
|---|---|---|---|---|---|
| 4,884,812 | A | * | 12/1989 | Nagasaki et al. | 473/342 |
| 5,301,946 | A | | 4/1994 | Schmidt et al. | 273/169 |
| 5,330,187 | A | | 7/1994 | Schmidt et al. | 273/169 |
| 5,492,327 | A | | 2/1996 | Biafore, Jr. | 273/173 |
| 5,536,011 | A | * | 7/1996 | Gutowski | 473/350 |
| 5,544,885 | A | * | 8/1996 | Besnard et al. | 473/350 |
| 5,564,705 | A | * | 10/1996 | Kobayashi et al. | 473/334 |
| 5,584,770 | A | | 12/1996 | Jensen | 473/350 |
| 5,593,356 | A | * | 1/1997 | Takeda | 473/335 |
| 5,599,243 | A | * | 2/1997 | Kobayashi | 473/335 |
| 5,616,088 | A | * | 4/1997 | Aizawa et al. | 473/341 |
| 5,669,826 | A | | 9/1997 | Chang et al. | 473/332 |
| 5,816,936 | A | | 10/1998 | Aizawa et al. | 473/342 |
| 5,827,132 | A | | 10/1998 | Bamber | 473/350 |
| 6,045,456 | A | | 4/2000 | Best et al. | 473/291 |
| 6,077,171 | A | * | 6/2000 | Yoneyama | 473/291 |
| 6,083,118 | A | * | 7/2000 | Martins et al. | 473/334 |
| 6,093,116 | A | | 7/2000 | Hettinger et al. | 473/332 |
| 6,210,290 | B1 | | 4/2001 | Erickson et al. | 473/345 |
| 6,368,231 | B1 | | 4/2002 | Chen | 473/329 |
| 6,406,382 | B1 | * | 6/2002 | Deshmukh et al. | 473/349 |

(Continued)

FOREIGN PATENT DOCUMENTS

JP 11-146934 2/1999

*Primary Examiner*—Sebastiano Passaniti
(74) *Attorney, Agent, or Firm*—Sheppard, Mullin, Richter & Hampton LLP

(57) ABSTRACT

The present invention resides in a perimeter-weighted, iron-type golf club head incorporating one or more internal chambers. The golf club head has a face plate defining a striking face of the club head and a body having an annular mass disposed behind the striking face. The annular mass extends about a periphery of the face plate defining an external cavity on a rear side of the face plate. The annular mass includes a top portion extending along a top edge of the face plate, a toe portion extending along a toe edge of the face plate, a heel portion, and a bottom portion. At least one internal chamber is located adjacent to the top edge, as defined by the top portion of annular mass. The club head also includes a weight member disposed in a recess defined by the bottom portion of the annular mass. The internal chamber, or a selected number of a plurality of internal chambers defined by the annular mass, can be filled to further manage the weight distribution of the club head. Thus, the club head can be tuned to accommodate requirements of an individual golfer.

9 Claims, 3 Drawing Sheets

U.S. PATENT DOCUMENTS 6,443,857 B1 9/2002 Chuang ..... 473/332
6,638,183 B1 * 10/2003 Takeda ..... 473/335
6,773,361 B1 * 8/2004 Lee ..... 473/335
2002/0013181 A1 1/2002 Bamber ..... 473/350
2002/0107087 A1 8/2002 Fagot ..... 472/291
2002/0165041 A1 11/2002 Takeda ..... 473/334

* cited by examiner

IRON-TYPE GOLF CLUB HEAD

BACKGROUND OF THE INVENTION

The present invention relates generally to golf club heads and, more particularly, to iron-type golf club heads.

The weight distribution of a club head is an important design consideration. Many iron-type golf club heads are configured in what is commonly known as "cavity back" design. Such designs allocate weight about the club's periphery. This peripheral weighting is generally considered to provide greater forgiveness for off-center shots than traditional blade-style club heads. As such, cavity back designs often are preferred by high handicap golfers.

Another, sometimes competing, consideration relates to the location of the club head's center of gravity (CG). A club having a low CG location is often preferred typically by less skilled players, for the increased ease in launching a golf ball. Alternatively, in the hands of an experienced golfer, a club head having a more centrally located CG provides greater control over the flight of the ball. Most club heads have a fixed weight distribution; consequently, very little can be done to tune the weight distribution of a club head to the particular needs of an individual golfer. To accommodate golfers across all skill levels, golf club manufacturers typically must carry several distinct product lines of golf clubs, which can increase production costs.

It should, therefore, be appreciated that there exists a need for an iron-type golf club head having weight allocated about its periphery and a low center of gravity for improved forgiveness for off-center shots, while providing an adaptable weight distribution profile to accommodate requirements of an individual golfer. The present invention fulfills this need and others.

SUMMARY OF THE INVENTION

A golf club head in accordance with the present invention incorporates one or more internal chambers provided in at least a part of the top portion of a perimeter weighted iron club head. The club head includes a face plate having a front side defining a striking face of the club head and a body having an annular mass disposed behind the striking face. The annular mass extends about a periphery of the face plate, thereby defining an external cavity centrally located on a rear side of the face plate. The annular mass includes a top portion extending along a top edge of the face plate, a toe portion extending along a toe edge of the face plate, a heel portion, and a bottom portion. An internal chamber is located adjacent to the top edge, as defined by the top portion of the annular mass.

The internal chamber, or a plurality of internal chambers defined by the annular mass, can be filled with a polymer, foam or high density filler, for example, to further manage the weight distribution of the club head. If the internal chamber or chambers within the top portion of the annular mass are left unfilled, lowering of the center of gravity (CG) of the head is maximized. A low CG is preferred by many golfers for the added ease in launching a golf ball. If the heel portion of a plurality of internal chambers in the top portion are filled, then the CG is moved toward the heel. This low, heelward CG location is preferred by many players for the ease of launch and ease of promoting right to left ball flight (slice reduction). Alternatively, internal chambers 44 disposed at the extreme ends of the heel and toe can be filled to achieve increased heel and toe weighting. Thus, the club head can be tuned to accommodate requirements of an individual golfer.

A separate face plate is preferably attached at the front of the head to close and conceal the internal chamber or chambers.

Preferably, a main body of the club head is formed with the internal chambers disposed in the top portion of the annular mass, and a face plate is attached to the front of the body. The body and face plate may be formed from a metallic material using, for example, conventional casting techniques. Adhesive, press-fitting, welding and other joining techniques may be used for attaching the face plate to the body. Alternatively, an integrally formed club head with internal chambers disposed at least in the top portion of the annular mass can be formed using techniques employing ceramic cores, soluble cores or pick-outs as known to those skilled in the art.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
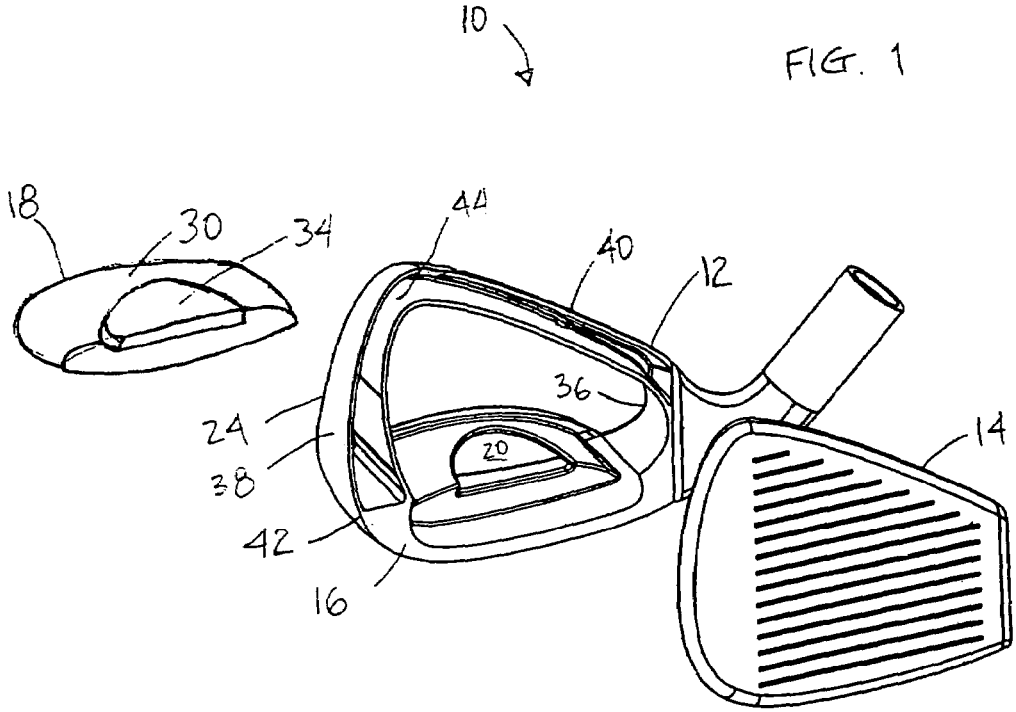
FIG. 1 is an exploded front view of a first preferred embodiment of a club head in accordance with the invention, depicting a face plate and a rear weight removed from a main body.

In accordance with the present invention, a perimeter weighted iron-type golf club head 10 includes a face plate 14 having a front side defining a striking face of the club head and a body 12 having an annular mass 24 disposed behind the striking face. The annular mass 24 extends about a periphery of the face plate 14, thereby defining an external cavity 28 centrally located on a rear surface 26 of the face plate. The annular mass 24 includes a top portion 40 extending along a top edge of the face plate 14, a toe portion 38 extending along a toe edge of the face plate, a heel portion 36, and a bottom portion 42. One or more internal chambers 44 are provided in at least a part of the top portion 40 of the annular mass 24.

With reference to the illustrative drawings, and particularly to FIG. 1, there is shown a club head 10 having a body 12 and a separately formed face plate 14. The face plate 14 is preferably welded about its periphery to a front 16 of the body 12. A weight member 18 is inserted into a recess 20 formed at a rear 22 of the body 12. Upon final assembly of the club head 10, an annular mass 24 of the body 12 and a rear surface 26 of the face plate 14 form an external cavity 28 at the rear of the club head 10 (see FIG. 3). Thus the face plate 14 and annular mass 24 close and conceal the internal chamber or chambers 44. The weight distribution profile of the club head 10 can be adapted to accommodate requirements of an individual type of golfer.

Figure 2:
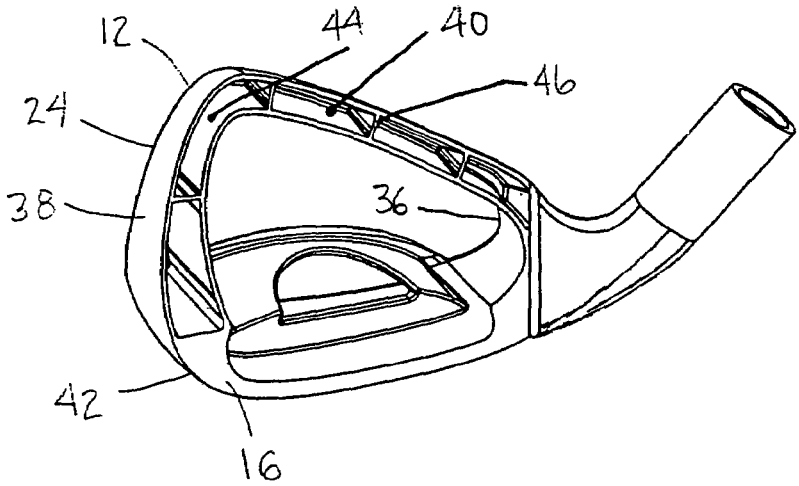
FIG. 2 is a front perspective view of a main body of a second preferred embodiment of a club head in accordance with the invention, having multiple hollow internal chambers in the top and toe portions of the club head.

With reference to FIGS. 1 and 2, the annular mass 24 of the body 12 comprises a heel portion 36, a toe portion 38, a top portion 40 and a bottom portion 42. In each embodiment, the annular mass 24 defines an internal chamber in at least part of the top portion 40 to promote a relatively lower center of gravity (CG) for the club head 10. As shown in the embodiment of FIG. 1, a single internal chamber 44 is formed that extends through a majority of the top portion 40 and into the toe portion 38 of the annular mass 24. In this embodiment, the internal chamber 44 is hollow. However, in other embodiments, any of a number of materials having a density different than the body 12, such as a polymer, a foam or a high density material, for example, can be used to fill the internal chamber 44 to obtain desired weight distribution and performance characteristics.

In the embodiment of FIG. 2, multiple internal chambers 44 partitioned by walls 46 are defined in the top and toe portions 40, 38 of the annular mass 24. The walls 46 are relatively thin, each having about the same thickness and also serve to further reinforce the club head 10. Beneficially, the inclusion of the walls 46 does not significantly increase the mass in the toe or top portions 38, 40. Thus, the CG of the club head 10 is still effectively low compared to an identical club head having solid toe and/or top portions 38, 40. In other embodiments, one or more of the walls 46 can be substantially thicker, even having a thickness comparable to the length of one of the internal chambers 44 depicted in FIG. 2. The internal chambers 44 can also be located or extended into one or both of the heel and toe portions 36, 38, as desired.

In certain applications, it is desirable to selectively fill one or more internal chambers 44 with a material having a different density than the body 12 for further mass management or for vibration dampening. For example, if selected internal chambers 44 within the heel portion 36 are filled, the CG is positioned more towards the heel than if the internal chambers were unfilled. The resultant low, heelward CG location is preferred by many players for the increased ease in launching a golf ball and right to left ball flight. Alternatively, internal chambers 44 disposed at the extreme ends of the heel and toe portions 36, 38 can be filled while keeping the internal chambers 44 disposed in the top portion 40 hollow to achieve increased heel and toe weighting. Similarly, if the internal chamber or chambers within the top portion of the annular mass are left unfilled, lowering of the center of gravity (CG) of the head is maximized. A low CG is preferred by many golfers for the added ease in launching a golf ball. Selected internal chambers 44 can be filled by the manufacturer to accommodate needs of a particular skill level of golfers, or even, to personalize the club head 10 to the needs of an individual golfer.

Figure 3:
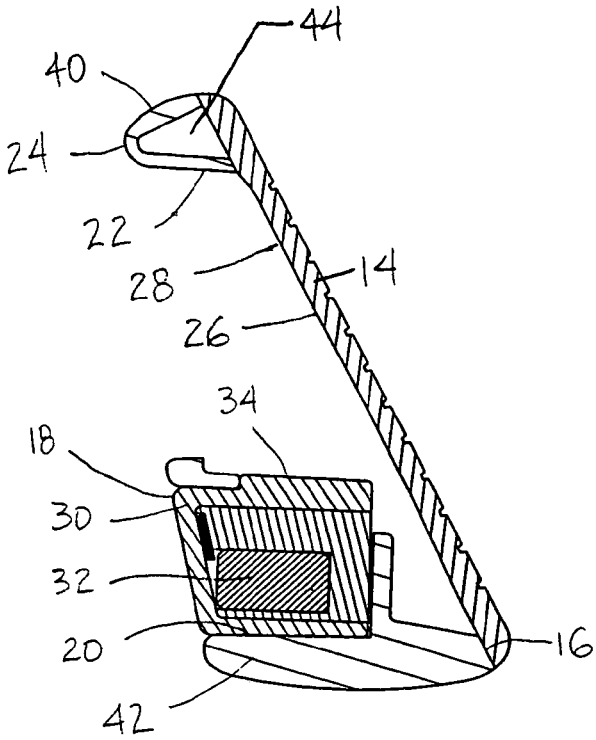
FIG. 3 is a vertical cross-section of the main body of FIG. 1.

With reference to FIG. 3, the weight member 18 aids in promoting a low CG for the club head 10. The weight member 18 preferably has a polymeric housing 30 with at least one high density element 32 enclosed therein. The weight member 18 is configured to be securely received in the recess 20. In this embodiment, the weight member 18 is removably affixed to the body 12 by a combination of a locking lip 34 and/or adhesive. Alternatively, the weight member 18 may be affixed using tabs formed on the housing 30 that are pressed into grooves formed in the walls of the recess 20. The weight member 18 can also be attached using other methods known to those skilled in the art. The weight member 18 can comprise a cartridge as disclosed in either of Applicants' co-pending U.S. application Ser. No. 09/728,955 filed Dec. 1, 2000 entitled GOLF CLUB HEAD or U.S. application Ser. No. 10/234,663 filed Sep. 3, 2002 entitled GOLF CLUB HEAD, the disclosures of both being incorporated herein. In the embodiment depicted in FIG. 4, a separate weight member 18 is not included.

Figure 4:
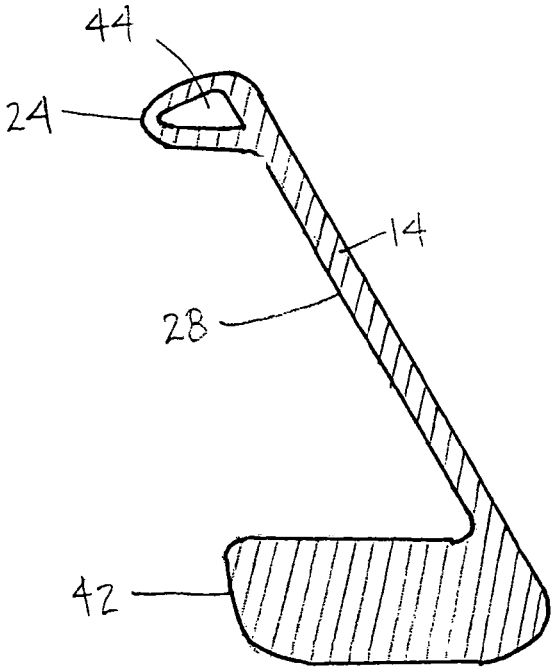
FIG. 4 is a vertical cross-section of a main body of another preferred embodiment.

FIGS. 3 and 4 show club heads formed in two preferred methods of the present invention. The material of the club head can comprise any metal, such as from the group of steel alloys, aluminum alloys and titanium alloys, for example. The body 12 and the face plate 14 can be formed from the same or different materials, and the attachment of the face plate 14 to the body 12 can comprise welding, adhesive bonding, press-fitting, or another method known to those skilled in the art. In one preferred embodiment, a body 12 is formed of 17-4 stainless steel and a face plate 14 is formed of a high strength steel alloy such as Carpenter Custom 455®. Alternatively, one of the body 12 and the face plate 14 can comprise a non-metallic material.

With reference to FIG. 3, the separate face plate 14 is attached to the front 16 of the body 12 and encloses the internal chamber 44. The face plate 14 can be stamped, forged, cold rolled or formed using any known technique. Any filler material for the internal chamber 44 can be added prior to the attachment of the face plate 14. The weight member 18 is preferably attached to the body 12 after the face plate 14. Alternatively, the weight member 18 can be omitted.

Figure 5:
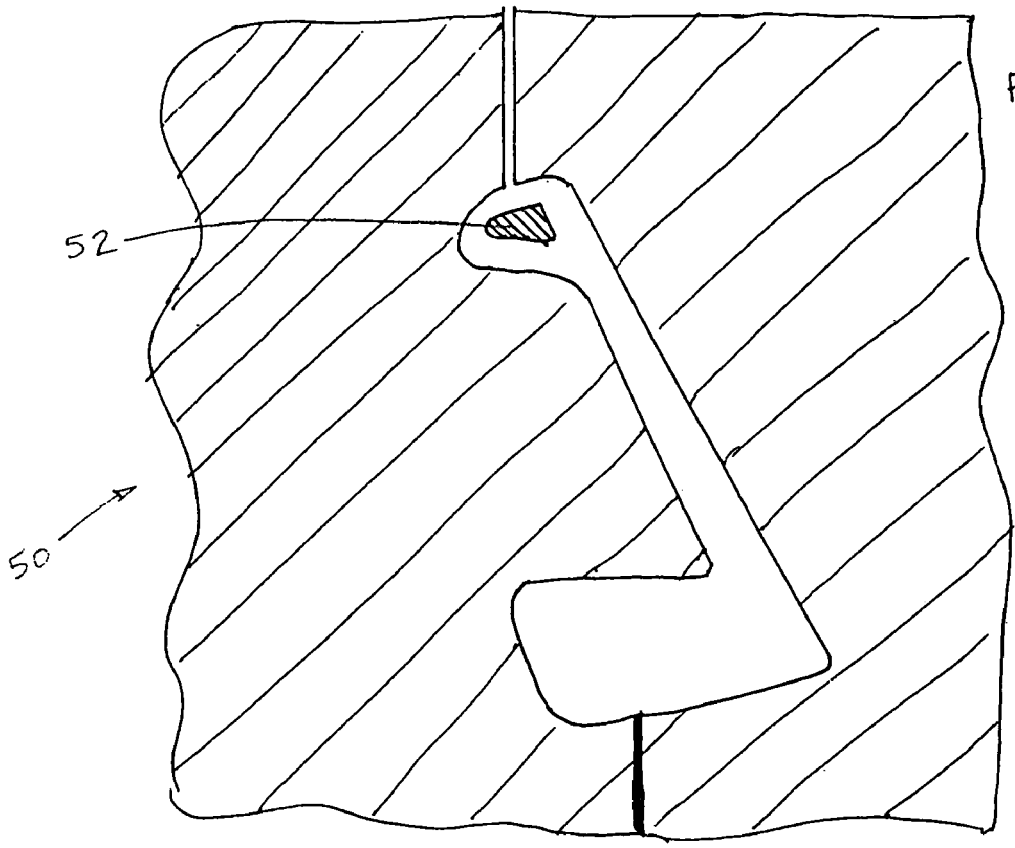
FIG. 5 is a cross-section of a mold for use in a preferred method of the present invention.
Figure 6:
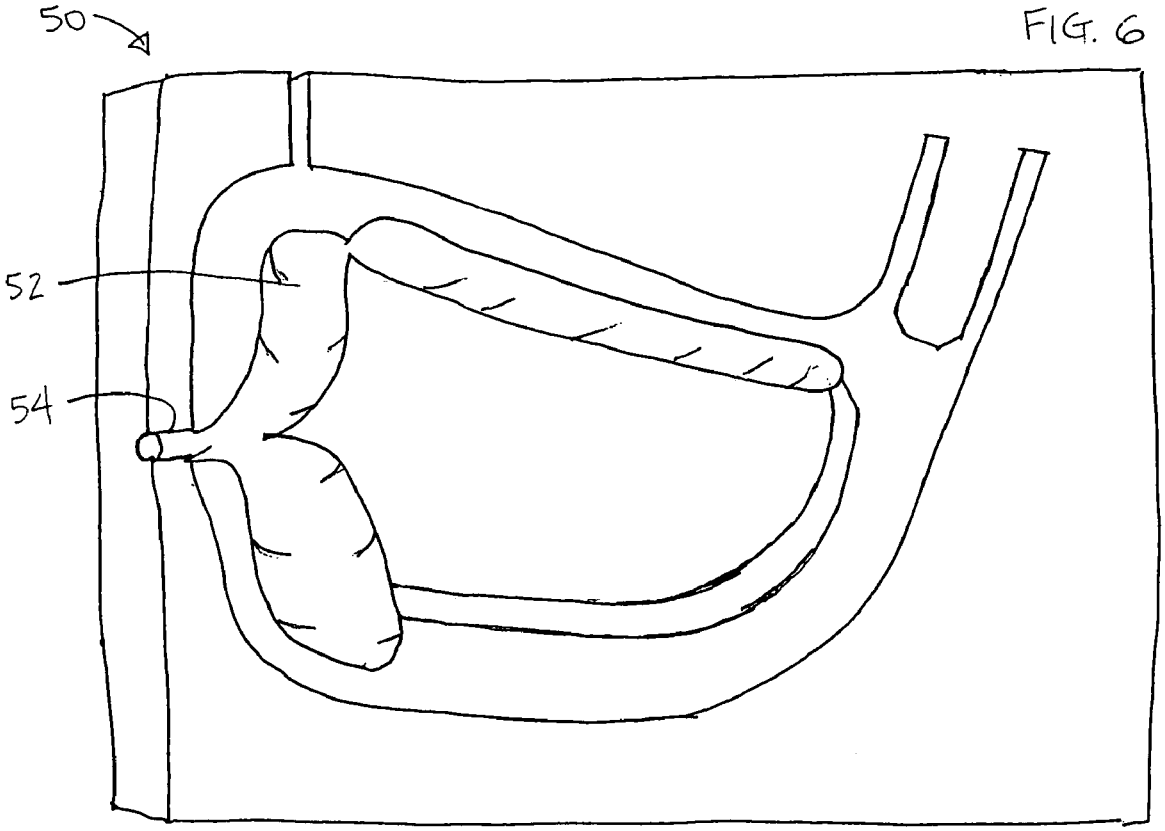
FIG. 6 is a front view of one part of the mold of FIG. 5.

With reference to FIG. 4, a face plate 14 is integrally formed with the body 12. The internal chamber 44 is created using any technique known to those skilled in the art, such as employing ceramic cores, soluble cores or pick-outs. A preferred method utilizes a mold such as shown in FIGS. 5 and 6 wherein a soluble core is used.

In this method, a mold 50 is provided for a body 12 having a front 16 and a rear 22, the rear having an annular mass 24 comprising a top portion 40, a toe portion 38, a heel portion 36 and a bottom portion 42. At least one soluble core 52 is placed in a region of the mold 50 corresponding to at least the top portion 40 of the body 12. The number and/or configuration of the soluble cores 52 used to create the desired internal chamber or chambers 44. The mold 50 is filled with a hot wax that forms the pattern for the club head 10. The soluble core 52 is removed through an aperture 54 left in the club head wax pattern. The club head 10 is then created by well-known investment casting process, and the aperture 54 is closed off to form the one or more internal chambers 44. Prior to closing the aperture 54, a material having a density different than the material of the body 12 can be introduced through the aperture 54 into the internal chamber 44.

It should be appreciated from the foregoing that the present invention provides an iron-type golf club head having a face plate defining a striking face of the club head and a body having an annular mass disposed behind the striking face. The annular mass extends about a periphery of the face plate defining an external cavity centrally located on a rear side of the face plate. The annular mass includes a top portion extending along a top edge of the face plate, a toe portion extending along a toe edge of the face plate, a heel portion, and a bottom portion. A single, elongated internal chamber or a plurality of internal chambers are provided and are preferably cast within the rear of the club head. At least one internal chamber is located adjacent to the top edge, as defined by the top portion of annular mass. The internal chamber, or a plurality of internal chambers defined by the annular mass, can be filled to further manage the weight distribution of the club head. Thus, the club head can be tuned to accommodate requirements of an individual golfer.

Although the invention has been disclosed in detail with reference only to the preferred embodiments, those skilled in the art will appreciate that additional composite faces for golf club heads and methods for manufacturing golf club faces can be included without departing from the scope of the invention. Accordingly, the invention is defined only by the claims set forth below.

We claim:

1. An iron-type golf club head comprising:

a face plate having a front surface and a rear surface, the front surface defining a striking face of the golf club head; and an annular mass coupled to and extending about a periphery of the rear surface of the face plate, thereby defining an external cavity opposing the striking face, the annular mass including a top portion extending along a top edge of the face plate, a toe portion extending along a toe edge of the face plate, a heel portion, and a bottom portion;

wherein the rear surface of the face plate and the annular mass completely enclose an internal chamber disposed within the top portion of the annular mass, and wherein the bottom portion of the annular mass does not include an internal chamber;

wherein the club head further comprises a weight member disposed in a recess defined by the bottom portion of the annular mass.

2. The golf club head of claim 1, wherein the rear surface of the face plate and the annular mass completely enclose a plurality of separate internal chambers disposed within the top portion of the annular mass.

3. The golf club head of claim 2, further comprising a filler material disposed within at least one of the internal chambers, the filler material having a density different than a density of the material of the annular mass.

4. The golf club head of claim 1, wherein the face plate and the annular mass are integrally formed.

5. The golf club head of claim 1, wherein the face plate and the annular mass are formed as separate components and the face plate is directly coupled to the annular mass.

6. The golf club head of claim 1, wherein the rear surface of the face plate and the annular mass completely enclose an internal chamber disposed within the toe portion of the annular mass.

7. The golf club head of claim 1, wherein the annular mass defines a hosel for receiving a golf club shaft.

8. An iron-type golf club head comprising:

a face plate having a front surface and a rear surface, the front surface defining a striking face of the golf club head; and an annular mass coupled to and extending about a periphery of the rear surface of the face plate, wherein the rear surface and the annular mass define an external cavity opposing the striking face, the annular mass including a top portion extending along a top edge of the face plate, a toe portion extending along a toe edge of the face plate, a heel portion, and a bottom portion;

wherein the rear surface of the face plate and the annular mass completely enclose an internal chamber disposed within the top portion of the annular mass, wherein the face plate and the annular mass are integrally formed; and wherein the club head further comprises a weight member disposed in a recess defined by the bottom portion of the annular mass.

9. An iron-type golf club head comprising:

a face plate having a front surface and a rear surface, the front surface defining a striking face of the golf club head; and an annular mass extending around a periphery of the rear surface of the face plate, thereby defining an external cavity opposing the striking face, the annular mass including a top portion extending along a top edge of the face plate, a toe portion extending along a toe edge of the face plate, a heel portion, and a bottom portion;

wherein the face plate and the annular mass are formed as a unitary body, the unitary body completely enclosing an internal chamber disposed within the top portion of the annular mass; and wherein the club head further comprises a weight member disposed in a recess defined by the bottom portion of the annular mass.

* * * * *